US008820685B2

(12) United States Patent
Michaut

(10) Patent No.: US 8,820,685 B2
(45) Date of Patent: Sep. 2, 2014

(54) METHOD FOR MANAGING THE CIRCULATION OF VEHICLES ON A RAILWAY NETWORK AND RELATED SYSTEM

(75) Inventor: Philippe Michaut, Saint-Remy les Chevreuse (FR)

(73) Assignee: ALSTOM Transport SA, Levallois-Perret (FR)

( * ) Notice: Subject to any disclaimer, the term of this patent is extended or adjusted under 35 U.S.C. 154(b) by 0 days.

(21) Appl. No.: 13/065,813

(22) Filed: Mar. 30, 2011

(65) Prior Publication Data

US 2012/0004796 A1 Jan. 5, 2012

(30) Foreign Application Priority Data

Apr. 1, 2010 (FR) ..... 10 52472

(51) Int. Cl.
*B61L 19/00* (2006.01)

(52) U.S. Cl.
USPC ..... 246/131; 701/19; 246/14; 246/27; 246/132; 246/218

(58) Field of Classification Search
None
See application file for complete search history.

(56) References Cited

U.S. PATENT DOCUMENTS 3,819,932 A * 6/1974 Auer et al. ..... 246/1 R
4,122,523 A * 10/1978 Morse et al. ..... 701/117
5,398,894 A * 3/1995 Pascoe ..... 246/28 R
5,420,883 A * 5/1995 Swensen et al. ..... 375/138
5,437,422 A * 8/1995 Newman ..... 246/5
5,463,552 A * 10/1995 Wilson et al. ..... 701/117
6,135,396 A * 10/2000 Whitfield et al. ..... 246/182 R
6,154,735 A * 11/2000 Crone ..... 706/45
6,459,964 B1 * 10/2002 Vu et al. ..... 701/19
6,694,231 B1 * 2/2004 Rezk ..... 701/19
6,799,097 B2 * 9/2004 Villarreal Antelo et al. ... 701/19
6,853,889 B2 * 2/2005 Cole ..... 701/19
6,915,191 B2 * 7/2005 Kane et al. ..... 701/19

(Continued)

FOREIGN PATENT DOCUMENTS

EP 1 498 338 A1 1/2005
EP 1 630 059 A2 8/2005

OTHER PUBLICATIONS

Ahmad Mirabadi, Automatic Generation and Verification of Railway Interlocking Control Tables Using FSM and NUSMV, Iran University of Science and Technology, School of Railway Engineering Transport Problems 2009.*

(Continued)

*Primary Examiner* — Thomas Tarcza
*Assistant Examiner* — Richard Goldman
(74) *Attorney, Agent, or Firm* — Davidson, Davidson & Kappel, LLC

(57) ABSTRACT

A method is provided. The method includes, the railway network being subdivided into resources, the state being driven by a ground controller, and each vehicle including an onboard controller being capable of communicating with the ground controller. The method includes planning, by a regulating unit, of a vehicle's mission, transmitting said mission to the vehicle. The onboard controller of identifying a group of resources permitting the vehicle to continue its mission, reserving the identified resources with the ground controllers, once all of the resources are allocated, interlocking each resource in a required state, verifying that each resource is reserved and is in the required state and, when this verification is positive, extending permission for the vehicle to move on the path corresponding to said group of resources.

19 Claims, 3 Drawing Sheets

(56) References Cited

U.S. PATENT DOCUMENTS

| | | | | |
|---|---|---|---|---|
| 7,089,093 | B2 * | 8/2006 | Lacote et al. | 701/19 |
| 7,092,894 | B1 * | 8/2006 | Crone | 705/7.26 |
| 7,099,754 | B2 * | 8/2006 | Sugita et al. | 701/19 |
| 7,139,646 | B2 * | 11/2006 | Kane et al. | 701/19 |
| 7,201,350 | B2 * | 4/2007 | Sugita et al. | 246/122 R |
| 7,269,487 | B2 * | 9/2007 | Watanabe et al. | 701/19 |
| 7,386,391 | B2 * | 6/2008 | Morariu et al. | 701/117 |
| 7,558,740 | B2 * | 7/2009 | Matheson et al. | 705/7.26 |
| 7,706,967 | B2 * | 4/2010 | Knockeart et al. | 701/119 |
| 7,715,977 | B2 * | 5/2010 | Julich et al. | 701/117 |
| 7,725,249 | B2 * | 5/2010 | Kickbusch et al. | 701/117 |
| 7,734,383 | B2 * | 6/2010 | Philp et al. | 701/19 |
| 7,797,088 | B2 * | 9/2010 | Philp et al. | 701/19 |
| 7,813,846 | B2 * | 10/2010 | Wills et al. | 701/19 |
| 7,869,939 | B2 * | 1/2011 | Kikuchi et al. | 701/423 |
| 7,937,193 | B2 * | 5/2011 | Philp et al. | 701/19 |
| 8,082,071 | B2 * | 12/2011 | Daum et al. | 701/19 |
| 8,126,601 | B2 * | 2/2012 | Kapp et al. | 701/20 |
| 8,140,203 | B2 * | 3/2012 | Noffsinger et al. | 701/20 |
| 8,224,510 | B2 * | 7/2012 | Daum et al. | 701/19 |
| 8,234,023 | B2 * | 7/2012 | Kumar | 701/20 |
| 8,290,645 | B2 * | 10/2012 | Chandra et al. | 701/19 |
| 8,321,079 | B2 * | 11/2012 | Degouge et al. | 701/19 |
| 2003/0183697 | A1 * | 10/2003 | Porter | 235/492 |
| 2003/0236598 | A1 * | 12/2003 | Villarreal Antelo et al. | 701/19 |
| 2004/0111309 | A1 * | 6/2004 | Matheson et al. | 705/8 |
| 2005/0234757 | A1 * | 10/2005 | Matheson et al. | 705/8 |
| 2006/0212183 | A1 * | 9/2006 | Wills et al. | 701/19 |
| 2006/0212184 | A1 * | 9/2006 | Philp et al. | 701/19 |
| 2007/0176054 | A1 * | 8/2007 | Mally | 246/15 |
| 2010/0063656 | A1 * | 3/2010 | Knott et al. | 701/19 |
| 2010/0063657 | A1 * | 3/2010 | Kumar | 701/19 |

OTHER PUBLICATIONS

Klose, C: "Funkbasierter Fahrbetrieb (FFB)—ein Update" Signal + Draht, Telzlaff Verlag GMBH. Darmstadt, DE, vol. 88, No. 12, Jan. 1, 1996, pp. 29 to 30, XP001539808, ISSN: 0037-4997.

Reissner, F. et al: "Funkfahrbetrieb Technisches Konzept" Signal + Draht, Telzlaff Verlag GMBH. Darmstadt, DE, vol. 89, No. 9, Sep. 1, 1997, pp. 28 to 34, XP000779785, ISSN: 0037-4997.

Arms, J. et al: "Funkfahrbetrieb im Ubergang von der Entwicklung zur Pilotrealisierung", ETR Eisenbahn-Technische Rundschau, Hestra-Verlag. Darmstadt, DE, vol. 49, No. 7 to 8, Jan. 1, 2000, pp. 476-486, XP001539833, ISSN: 0013-2845.

Krittian, F: "Fahrwegsteuerung and Sicherung Ueber Direkte Funkverbindunt mit dem Zug" Electrische Bahnen, Oldenbourg Industrieverlag, Munich, DE, vol. 103, No. 10, Oct. 1, 2005, pp. 473 to 477, XP001235620, ISSN: 0013-5437.

* cited by examiner

METHOD FOR MANAGING THE CIRCULATION OF VEHICLES ON A RAILWAY NETWORK AND RELATED SYSTEM

This claims the benefit of French Priority Application FR 10 52472, filed Apr. 1, 2010 and hereby incorporated by reference herein.

The invention relates to the field of methods and systems for managing the circulation of a vehicle on a railway network.

In this document, the term "vehicle" refers to any vehicle capable of moving on a railway network, such as a train, tramway, or subway, for example.

BACKGROUND

A railway network is made up of various elementary objects, such as a track section with two end points, a track section with three end points or coupled switches, a signaling element, etc.

At a given moment, each object is in an interlocking state assuming a specific value among a plurality of predefined possible values.

To date, an interlocking logic is used to authorize a vehicle to move safely along a route of the railway. The interlocking logic is implemented by centralizing equipment, hereinafter called control unit, which controls the interlocking state of all of the elements composing the network.

The interlocking logic uses a route table that shows, for each possible route, the values of the interlocking states of the objects composing said route that must be simultaneously verified to authorize the vehicle to move safely on the considered route. The definition of the route table is a compromise between flexibility and operating possibilities, technical feasibility and cost, while also considering deadlocks between movements.

It is the control unit that, each moment, selects a route for a vehicle, modifies the interlocking state of the objects composing that route in compliance with the conditions mentioned in the route table, then, after verifying compliance with those conditions, authorizes the vehicle to move on the route.

The control unit thus manages the movement of all of the vehicles circulating, at any given moment, on the railway network.

The complexity of the route tables and the need for them to guarantee safe movements on the railway network that they describe, require that the route tables be generated manually, by experts. As a result, the creation of the route tables is a very costly step in terms of resources.

Lastly, this architecture does not permit to update easily an existing railway network. For example, the replacement or addition of an object must be followed by the rewriting of the route table and its qualification before it can be integrated at the control unit.

SUMMARY OF THE INVENTION

The invention aims to remedy the abovementioned problems.

It is an object of the present invention to provide a method for managing the circulation of vehicles on a railway network, characterized in that, the network being subdivided into a plurality of resources, each resource having an allocation state, assuming the value "allocated" or "unallocated," and having an interlocking state, assuming one value from among a plurality of predetermined values, one or several resources being driven by a ground controller equipped with wireless communication means, a regulating unit capable of planning all of the movements of the vehicles circulating on the network, and being connected to fixed base stations, on the ground, including wireless communication means, and each vehicle circulating on the network including an onboard controller equipped with wireless communication means permitting to communicate with the ground controllers and base stations connected to the regulating unit, the method comprising:

planning, by the regulating unit, of a mission assigned to a vehicle;

transmission of said mission from the regulating unit to the controller onboard said vehicle;

identification, for a given time slot of the mission, by the controller onboard said vehicle, a group of resources that, on the condition each of said resources is allocated to said vehicle and is in a required interlocking state, would permit said vehicle to continue said mission, by using a path on the network corresponding to said group of identified resources;

reservation of the identified resources, consisting, by implementing a predetermined protocol, in the onboard controller requiring, from each of the ground controllers associated with the resources of the group of identified resources, the specific allocation of said resource to said vehicle;

then, once all of the resources of said group have been allocated to said vehicle, the interlocking of the resources, consisting, by implementing a predetermined protocol, of the onboard controller requiring, from each of the ground controllers associated with the resources of said group of allocated resources, the modification of the interlocking state of said resource in compliance with the required interlocking states;

verification, by the onboard controller of said vehicle, that each of the resources of the group of identified resources has been allocated to it and is in the required interlocking state; and, when the result of this verification is affirmative, extension of the authorization, by the onboard controller, for the vehicle to move on the path of the network corresponding to the group of identified resources, allocated and correctly interlocked.

According to specific embodiments, the method includes one or several of the following features, considered alone or according to all technically possible combinations:

the controller onboard a vehicle sends the regulating unit, via the base stations, information on the position and/or group of identified resources, and the planning uses this information to update the various missions assigned to the different vehicles circulating on the railway network;

the method also includes a step for releasing a resource allocated to a vehicle, consisting in that, by carrying out a predetermined protocol, the controller onboard said vehicle requires, from the ground controller associated with said allocated resource, that said resource no longer be allocated to it;

the step for identifying a resource takes into account, in addition to said mission, descriptive information of the network and instantaneous position information on the vehicle;

the identification step includes a step for estimating a speed profile of the vehicle along a path of the network corresponding to a group of potential resources, preferably to determine the required time slot associated with each resource of a group of identified resources;

the step for allocating an identified resource includes:

emitting, by the controller onboard a vehicle, a request asking for the allocation of said identified resource sent to the ground controller associated with that resource;

emitting, by said ground controller, an allocation response delivering the allocation state and/or the interlocking state of the resource;

verifying, by the onboard controller, that there is no pending reservation and/or that no interlocking has interlocking states that are incompatible with the requested interlocking states; the step for engaging an allocated resource includes:

emitting, by the controller onboard a vehicle, a request asking for the interlocking of said resource allocated to said vehicle, sent to the ground controller who is associated with said resource;

verifying, by said ground controller associated with said resource, whether the interlocking parameters for the current state of said resource are different from the requested interlocking parameters, and, in the affirmative, driving the resource according to the interlocking parameters; and, emitting, by said ground controller, an interlocking response indicating the instantaneous interlocking state of the resource;

the step for releasing an allocated resource includes:

emitting, by the controller onboard the vehicle, a request asking for the release of said resource allocated to said vehicle, sent to the ground controller associated with said resource;

verifying, by said ground controller associated with said resource, whether the latter is allocated to the vehicle and, in the affirmative, no longer allocating said resource to the vehicle; emitting, by said ground controller, a release response indicating that the resource is no longer allocated to said vehicle.

The invention also relates to a controller onboard a vehicle circulating on a railway network, the network being subdivided into a plurality of resources that respectively have an allocation state, assuming the value "allocated" or "unallocated," and an interlocking state, assuming one value from among a plurality of predetermined values, one or several resources of the network being associated with a single ground controller, each ground controller including: radio communication means; processing means permitting to allocate the associated resource and order a change in the interlocking state of the associated resource; driving means capable of determining the instantaneous interlocking state of the associated resource and, on command by the processing means, driving the associated resource according to the interlocking parameters of a received interlocking request, the onboard controller includes:

radio communication means permitting to exchange messages between the onboard controller and the ground controllers;

identification means permitting to identify a group of resources that, on the condition each of said resources is allocated to said vehicle and is in a requested interlocking state, would permit said vehicle to continue an mission, by taking a path on the network corresponding to said group of identified resources, the mission being managed by a regulating unit including planning means so as to manage, on the network scale, the movements of the vehicles and to create an mission for each of them, the regulating unit being connected to fixed base stations, on the ground, including wireless communication means permitting communication with the onboard controller to transmit the mission assigned to said vehicle;

allocation and release means permitting, from a group of identified resources, to generate resource allocation requests intended to be sent to the ground controllers associated with said identified resources, and to process resource allocation responses coming from said ground controllers, and permitting, from a group of allocated resources, to generate resource interlocking requests, which include interlocking parameters, intended to be sent to the ground controllers associated with these allocated resources, and to process resource interlocking responses coming from said ground controllers;

verification means permitting to verify that all of the resources of a group of identified resources have been allocated to said vehicle and all of the resources of a group of allocated resources are in the requested interlocking state.

According to other specific embodiments, the onboard controller includes one or several of the following features, considered alone or according to all technically possible combinations: the allocation and release means are capable, based on a plurality of allocated resources, of generating resource release requests intended to be sent to the ground controllers associated with said allocated resources, and to process resource release responses coming from said ground controllers;

the controller includes positioning means capable of delivering instantaneous position information for said vehicle;

the controller includes a database including a detailed description of the resources composing the railway network;

the controller includes means for estimating a speed profile of the vehicle on a group of potential resources;

the controller includes at least one list corresponding to a group of identified resources, the list including, for each resource in the group:

a resource identification field;

preferably, a field corresponding to a required allocation time slot for the resource;

a field corresponding to the "allocated" or "unallocated" allocation state of the resource to the vehicle;

a field defining the required interlocking state for the resource; and, an interlocking field corresponding to a flag indicating that the resource is indeed in the required interlocking state.

The invention also relates to a ground controller capable of being associated with at least one resource of a railway network, the network being subdivided into a plurality of resources that respectively have an allocation state, assuming the value "allocated" or "unallocated," and an interlocking state, assuming one value from amongst a plurality of predetermined values, and, onboard a train circulating on the network, an onboard controller including radio communication means and allocation and release means making it possible to generate a resource allocation request intended to be sent to the ground controller, or a resource interlocking request, which includes interlocking parameters, intended to be sent to the ground controller.

The ground controller includes:

radio communication means capable of receiving an allocation or interlocking request for the resource associated with the ground controller;

processing means capable of allocating the associated resource in compliance with a received allocation request and ordering a modification of the interlocking state of the associated resource in compliance with a received interlocking request;

driving means capable of determining the instantaneous interlocking state of the associated resource and, upon command from the processing means, driving the associated resource according to the interlocking parameters of the interlocking request.

According to specific embodiments, the ground controller includes one or several of the following features, considered alone or according to all technically possible combinations:

the ground controller includes an allocation table including a stack of cells, each cell containing either the value NULL, or the identifier for a vehicle to which the resource is allocated;

the ground controller includes, for the or each resource associated with it, an interlocking state table including as many fields as there are parameters completely characterizing the interlocking state of said resource.

The invention also relates to a system for managing the circulation of vehicles on a railway network, characterized in that, the network being subdivided into a plurality of resources, each resource having an allocation state assuming the value "allocated" or "unallocated" and having an interlocking state, assuming one value from amongst a plurality of predetermined values, the system includes:

i)—a plurality of ground controllers, each ground controller being a ground controller as described above;

ii)—an onboard controller onboard a vehicle, the onboard controller being an onboard controller as described above; and, iii)—a regulating unit including planning means so as to manage, on the network scale, the movements of the vehicles and to create a mission for each of them, the regulating unit being connected to fixed base stations, on the ground, including wireless communication means permitting communication with the controller onboard a vehicle to transmit the mission generated by the regulating unit assigned to said vehicle.

BRIEF DESCRIPTION OF THE DRAWINGS

The invention and its advantages will be better understood upon reading the following description, provided solely as an example and done in reference to the appended drawings, in which.

DETAILED DESCRIPTION

Figure 1:
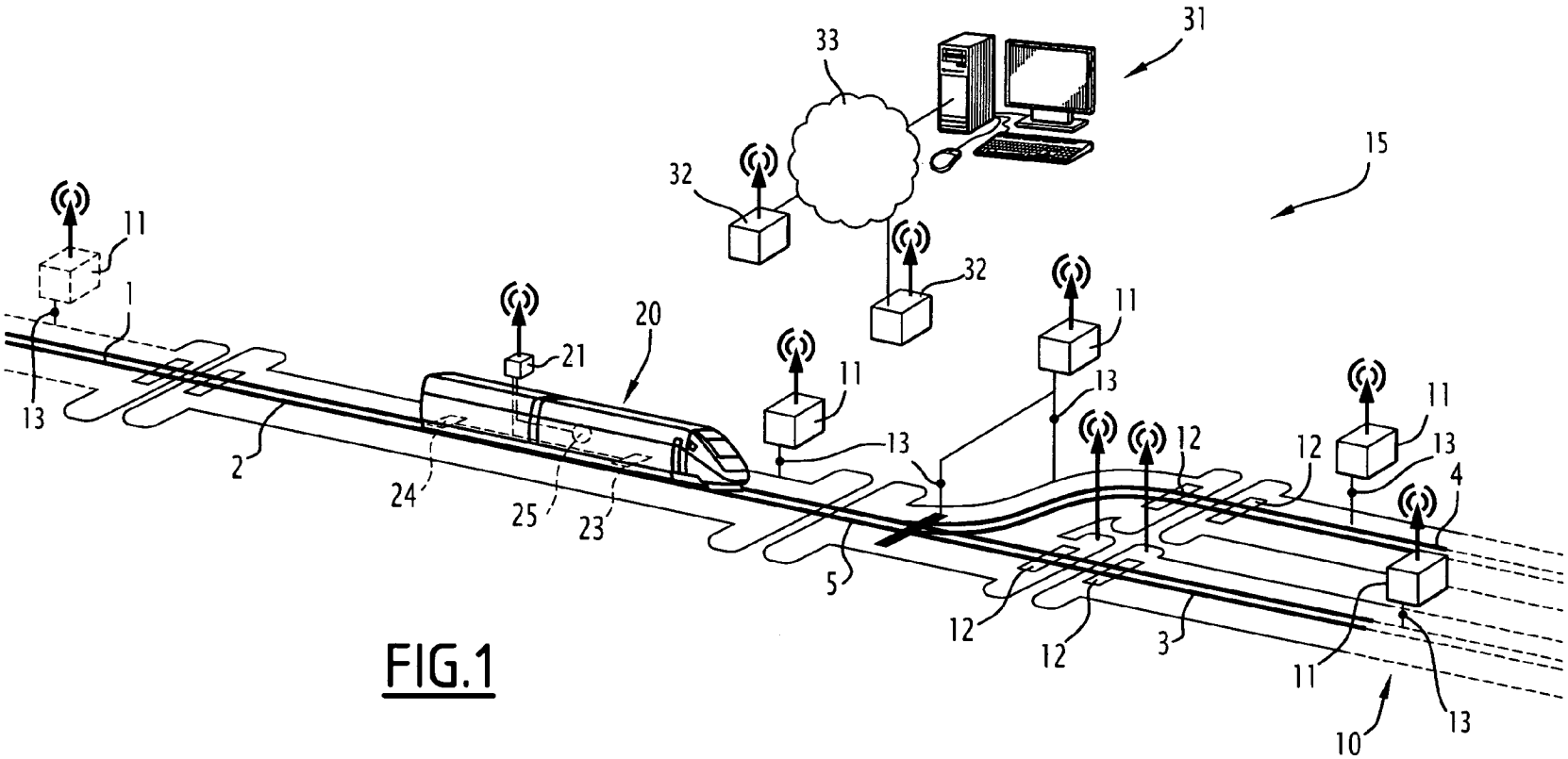
FIG. 1 is a schematic view of a portion of a railway network on which a train circulates.
Figure 2:
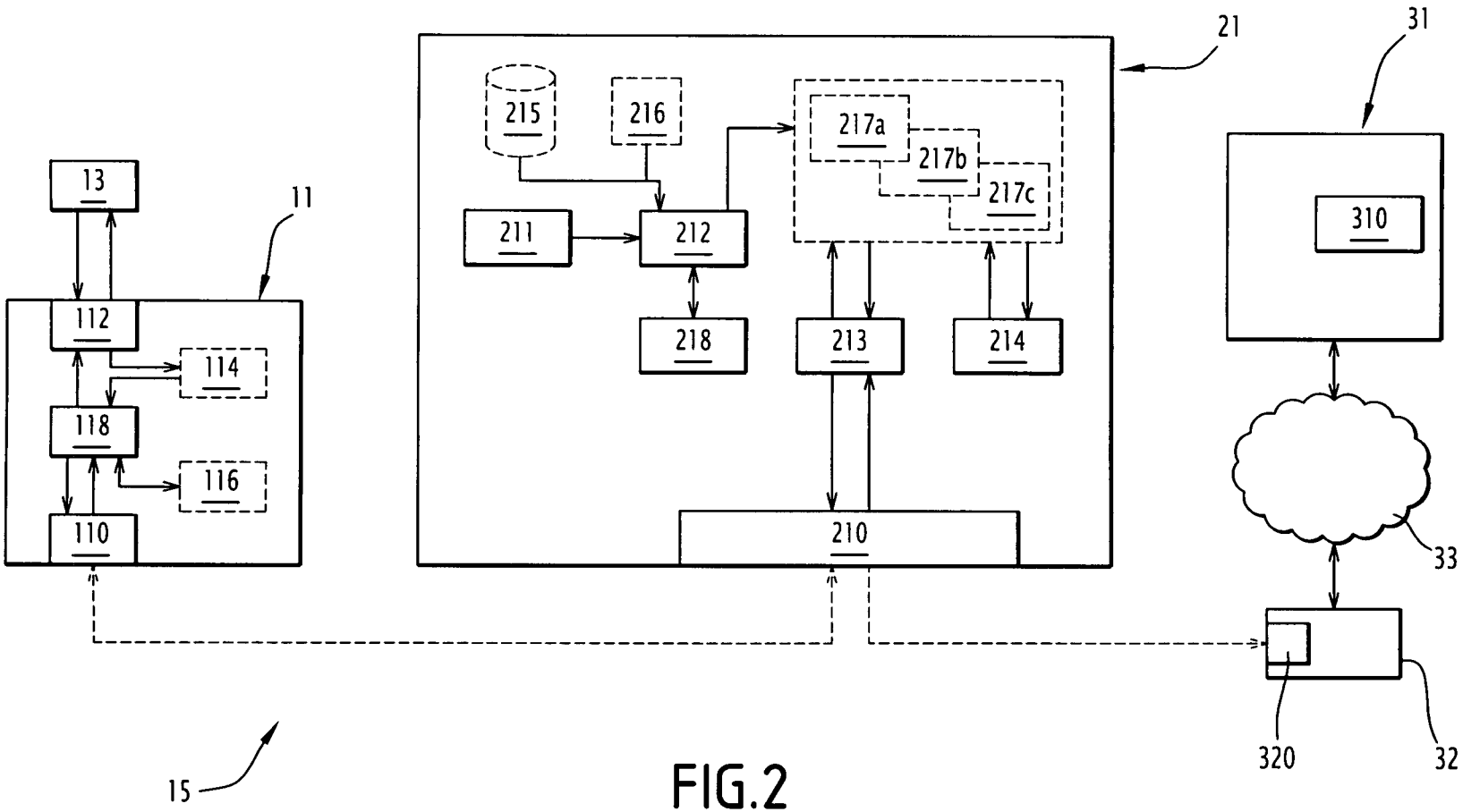
FIG. 2 is a schematic illustration of the elements composing the system for managing the circulation of trains according to the present invention, and flows of data between said elements.

FIG. 1 shows a portion of a railway network 10.

The network 10 is subdivided into a plurality of objects that are, according to the invention, considered to be resources. FIG. 1, for example, shows four sections of track with two end points, referenced 1 to 4, and one section of track with three end points, or switches, referenced 5.

The network 10 includes other resources, such as signaling elements, for example, which are not described or shown for the sake of clarity of this description.

Each resource of the network 10 can be associated with one or several members 13. A member 13 can have a sensor function relative to the value of a characteristic parameter of the resource. A member 13 may have an actuating function permitting to modify the value of the corresponding characteristic parameter.

The instantaneous interlocking state of a resource is the combination of the values of several parameters permitting to completely characterize the state of the resource.

For example, in the case of a track section with two end points, a member including an induction sensor capable of detecting the presence of a train on the track section permit to determine the "occupied" or "unoccupied" occupation state of that track section.

Also for example, in the case of a signaling element, a member permit to modify the display state of the signaling element.

In FIG. 1, a single train 20 is shown. But, at a given moment, several trains can circulate simultaneously on the network 10.

To manage the circulation of the trains on the network 10, a system for managing the circulation of the trains 15 is implemented.

The system 15 includes:

a plurality of ground controllers 11, called ROC (Radio Object Controller) hereinafter, each resource of the network being associated with an ROC;

a plurality of onboard controllers 21, called board controllers, a single board controller 21 being placed onboard each of the trains 20 circulating on the network; and a regulating unit 31, capable of planning the circulation of the various trains 20 circulating on the network 10.

The principle of the invention lies in the fact that the circulation of trains is, on a first scale, planned by the regulating unit, and, on a second scale, smaller than the first, managed, safely, by each train's board controller.

The planning by the regulating unit 31 of the circulation of a train includes the development of a mission sheet that is then sent to the train's board controller.

The management by the board controller of a train's circulation is done by implementing a protocol permitting to allocate, interlock, then release the necessary resources directly with the ROC with which they are associated. In this architecture, it is the board controller that authorizes the movement, safely, of the train on the path made up of the resources allocated to the train and permitting it to continue the mission assigned to it.

In the embodiment described in detail here, a resource of the network 10 is associated with a single ROC. However, alternatively, several resources 10 can be associated with a single ROC. Each ROC and each resource are characterized by a unique identifier, on the network 10. In the following, one ROC per network resource is considered.

An ROC 11 is a computer including storage means, computation means, and input/output interfaces.

The purpose of an ROC 11 is to control the resource with which it is associated. An ROC is a machine connected, via a wired line that may for example be bidirectional, to the or each member of the resource with which the ROC is associated, so as to drive that resource. An ROC 11 is arranged physically close to the resource it controls.

For resources not having a member to drive, the ROC can be placed anywhere.

Each ROC 11 includes:

radio communication means 110, permitting to establish a wireless connection with radio communication means 210 equipping the board controller 21 of a train 20, then exchanging, over the established wireless connection, messages according to a predetermined communication protocol. The communication means 110 transfer only the message that include the identifier of the ROC 11 to the processing means 118;

driving means 112 permitting to drive the or each member 13 of the associated resource;

an interlocking state table 114, including as many fields as there are characteristic parameters permitting to define the instantaneous interlocking state of the associated resource, a field of the table 114 being updated by the driving means 112 as a function of the data indicated by the member corresponding to said characteristic parameter;

an allocation table 116, including a stack of cells, each cell corresponding to a reservation or an interlocking of the resource and being able to assume the value "0" when the resource is "unallocated," or the identifier of a train when the resource is "allocated" to that train; and processing means 118, capable of reading and writing in the allocation table 116, reading in the interlocking state table 114, controlling the driving means 112 and the radio communication means 110.

The means 110, 112 and 118 are preferably implemented in the form of computer programs whereof the instructions are stored in the storage means of the ROC 11 and are capable of being executed by the computation means of the ROC 11.

A board controller 21 is a computer including storage means, computation means, and input/output interfaces.

Each board controller 21, and as a result each train, is characterized by a unique identifier on the network 10.

Each board controller 21 includes:

radio communication means 210, permitting to communicate simultaneously with several ROCs 11. Preferably, these communication means also permit to establish a wireless connection with a base station 32 that is connected to the regulating unit 31;

positioning means 211;

identification means 212 permitting to identify a group of resources of the network 10 that would permit the train 20 to continue the performance of its mission;

resource allocation and release means 213;

verification means 214; and estimating means 218.

Preferably, these different means are implemented in the form of computer programs executed by the board controller 21.

Moreover, the storage means of the board controller 21 include a database 215 for describing the railway network 10 and a mission file 216 transmitted by the regulating unit 31.

The database 215 includes information providing a detailed description of the resources composing the network 10. The database 215 thus includes, for each resource of the network 10, the interlocking state of the resource and geographical positioning data for the resource, such as the geographic positions of the end points thereof.

The mission file 216 includes information corresponding to the journey the train 20 must make through the network 10. For example, the mission file 216 includes the departure point of the train 20, the arrival point of the train 20, and an ideal path through the network 10, i.e. all of the track sections that permit to connect the departure and arrival points, as well as characteristic points such as the commercial stops including information on the arrival and departure times the train 20 must respect.

Preferably, the positioning means 211 permit to determine the position of the head and the rear portion of the train 20.

Within a track section, the position of the train 20 can be determined precisely by taking into account a measurement of the distance traveled from a reference point, e.g. a beacon of the state of the art.

The identification means 212 generate a list of resources 217, based on the information contained in the database describing the resources 215, in the mission file 216, and the instantaneous position of the train given by the positioning means 211.

A list 217 corresponds to a group of resources that, if they were allocated to the train and if they were located respectively in a required interlocking state, would permit the train to continue its mission along a path of the railway network 10 corresponding to that group of identified resources.

Thus, a list 217 includes one row per resource from the group of identified resources and columns respectively corresponding to:

an identification field indicating the resource identifier;

a field corresponding to a required time slot (in one simple embodiment, all of the resources from a group are to be allocated to the train in the same time slot);

a field corresponding to the "allocated" or "unallocated" allocation state of the resources to the train 20 (when the list 217 is generated, this field assumes the value NULL);

a field defining the required interlocking state for said resource; and an interlocking field, corresponding to a flag indicating that the resource is indeed in the required interlocking state (when the list 217 is generated, this field assumes the value NULL).

The estimating means 218 are capable of determining at least one speed profile on a path corresponding to a group of potential resources. From this speed profile, the means 218 are capable of estimating the passage moments of the train at particular points of said path. As a function of these passage moments, the identification means 212 determine the time slot in which each resource must be allocated to the train. The time slot thus required can take into account suitable safety margins, in particular the time necessary for the interlocking of the resource.

When the verification means 214 are executed, they determine whether all of the resources of a list 217 have indeed been allocated to the train 20, and whether all of the resources of a list 217 have the required interlocking state.

When the resource allocation/release means 213 are executed, they perform the allocation, interlocking, and release phases of a group of identified resources, according to the protocol described below, by reading and writing in a list 217, by generating the messages to be transmitted to the ROCs, and by processing the messages coming from the ROCs, via the radio communication means 210.

The system for managing the circulation of trains 15 also includes a regulating unit 31.

The regulating unit 31 includes planning means 310 permitting, on the network 10 scale, to develop the missions of the different trains circulating on said network 10. A train's mission is developed taking into account any restrictions imposed on the movement of the train in question, by the missions of other trains circulating on the network 10.

Preferably, a first train's mission is regularly updated so as, for example, to take into account an event affecting the performance of another train's mission, and thereby modifying the restrictions taken into account during the initial development of the first train's mission.

The regulating unit 31 is connected, for example through a TCP/IP network 33, to a plurality of fixed base stations 32 on the ground. Preferably, the base stations are distributed along the tracks of the network 10 to offer continuous coverage of the network 10. The base stations 32 include communication means 320 adapted to communicate with the board controller 21 of a train circulating on the network 10. Preferably, these radio communication means 320 are compatible with the radio communication means 210 of the board controller 21.

It is then possible to exchange data between the board controller 21 of the train 20 and the regulating unit 31: in downlink communication, the regulating unit communicates, aboard, the mission file 216 for the train 20, which it has just developed or updated; in uplink communication, the board controller 21 communicates its instantaneous position to the regulating unit 31 so that it can update the missions of the train 20 and of other trains circulating on the network 10.

The method for managing the circulation of trains on the network 10 implemented by the system 15 will now be described.

The file 216 describing the mission assigned to the train 20 is downloaded by the onboard controller 21 from the regulating unit 31 via a base station 32. This may be the first base station 32 that the train 20 encounters when it starts along the network 10, for example, at the train station or the exit of a maintenance garage or a depot, the mission file 216 then corresponding to the mission initially assigned to the train 20. It can also be an intermediate base station 32 for downloading a mission file corresponding to an update of the initial mission file.

At this moment, the train 20 is circulating on a path of the railway network 10 described by a list 217*a* stored by the board controller 21. This current path includes, for example, track sections 1 and 2.

To continue its movement and the performance of its mission, the method according to the invention provides a phase for allocating a group of resources and a phase for engaging the resources of the group of allocated resources.

Figure 3:
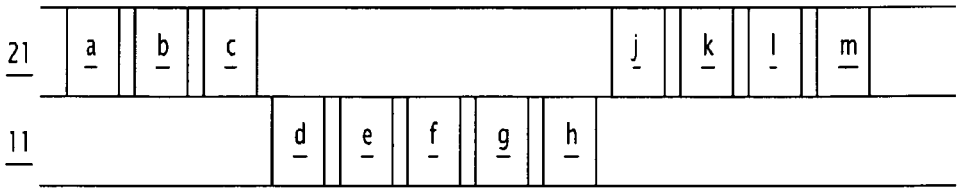
FIG. 3 is a schematic illustration of the method for managing the circulation of trains carried out by the system of FIG. 2.

The allocation phase shown in FIG. 3 includes the identification, then reservation of a group of resources.

In an identification step a, the identification means 212 are executed. They use the mission file 216, the database 215 for describing the resources composing the network 10, the instantaneous position of the train 20 delivered by the positioning means 211, to generate a group of potential resources. The identification means 212 call the estimating means 218 to develop, from this group of potential resources and for an upcoming required time slot, a group of resources identified as permitting the train to continue its mission by taking the path corresponding to those resources, on the condition that the latter have been allocated to the train 20 and are placed in a required interlocking state. The identification means 212 then generate a list 217*b* corresponding to said group of identified resources.

For example, in FIG. 1, for the train 20 to continue performing its mission, the means 212 generate a list 217*b* indicating that section 3 must be allocated to the train and must be in the interlocking state defined by the direction of circulation, and that section 5 must be allocated to the train and must be in the interlocking state defined by the direction of circulation and the positioning state.

Once the list 217*b* has been placed in the storage means of the board controller 21, the allocation/release means 213, which monitor the storage means of the board controller 21, are executed in a step b for developing resource allocation request messages. The means 213 develop as many requests as there are resources in the list 217*b*. Each request includes the identifier of the requesting train and the identifier of the requested resource.

In step c, the communication means 210 of the board controller 21, controlled by the means 213, emit radio signals corresponding to the different resource allocation requests.

In step d, the communication means 110 of an ROC 11 pick up the different radio signals received and only transmit the messages including the identifier for said ROC (identifier identical to that of the resource with which the ROC is associated) to the processing means 118.

In step e, the processing means 118 read the allocation table 116 to determine whether the resource can be allocated to the requesting train.

In step f, only when the table 116 indicates that the resource does not have a pending reservation, the processing means 118 allocate the resource to the requesting train, writing the identifier of the requesting train in the cell of the table 116.

Once a resource has been allocated, it cannot be allocated to another train, as long as the train to which it has been allocated does not interlock it.

In step g, the processing means 118 of the ROC 11 develop an allocation response message. This response includes the identifier of the requesting train, the identifier of the requested resource, and the current state of reservations and interlockings In step h, the communication means 110 emit a radio signal corresponding to this allocation response.

In step j, the communication means 210 of the board controller 21 pick up and decode the various signals that reach them, and only transmit the messages that include the identifier of the train 20 to the allocation/release means 213.

In step k, when the allocation response indicates that the requested resource has indeed been allocated to the train, the means 213 update the allocation field corresponding to that resource in the list 217*b*. The "allocated" value (+1) is written in the resource's allocation field.

When the allocation response indicates that the requested resource cannot be allocated to the train, the means 213 update the allocation field for that resource by writing the "unallocated" value (0) there.

At the end of a predetermined duration after step c of issuing resource allocation requests, the verification means 214 are executed by the onboard controller 21 to verify whether, yes or no, all of the resources from the list 217*b* have indeed been allocated to the train 20. The verification means 214 then test the value of the allocation field for each of the resources in the list 215 (step 1).

In case of positive verification, indicating that all of the requested resources from the list 217*b* have been allocated to the train 20, that no reservation is pending, and/or that no interlocking has interlocking parameters that are incompatible with the requested interlocking parameters, the group of identified resources is considered a group of allocated resources (step m) and the method goes to the interlocking phase, which will be described below.

In case of negative verification, i.e. when at least one of the resources from the list 217*b* is indicated as not being able to be allocated to the train 20, the identification means 212 are executed again to generate another list 217*c* corresponding to another group of identified resources. The information relative to the resources from the list 217*b* that could not be allocated to the train 20 may be used by the means 212 during this new identification of a group of resources (step a).

In case of incomplete verification, i.e. when several allocation fields from the list 217*b* still include the value NULL (and no "0" value) when the verification occurs, additional time is given and the verification means 214 are executed again several moments later. The allocation/release means 213 may be executed again to carry out steps b and c on the resources from the list 217*b* that are not yet allocated to the train 20. If, during the following verification, some of the allocation fields from the list 217*b* remain at a NULL value, the verification is considered negative, and the board controller 21 tries to identify another group of resources (step a).

Figure 4:
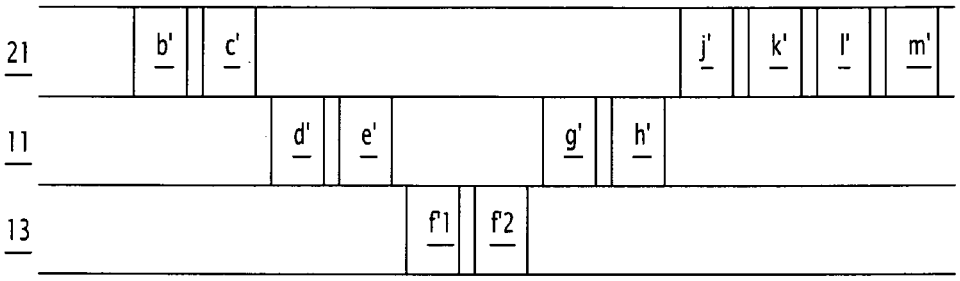
FIG. 4 is a schematic illustration of the interlocking phase of said method.

The interlocking phase, illustrated in FIG. 4, unfolds as follows:

When a group of resources is indicated as being allocated, the board controller 21 executes the allocation/release means 213 to develop a plurality of resource interlocking request messages (step b'). The means 213 develop as many requests as there are resources in the list 217*b*. Each resource interlocking request includes the identifier for the requesting train, the identifier for the requested resource, and the interlocking parameters required for that resource.

In step c', the communication means 210 of the board controller 21, controlled by the means 213, emit radio signals corresponding to the various resource interlocking requests.

In step d', the communication means 110 of an ROC 11 pick up and decode the different radio signals received and only transmit the messages including the identifier of the ROC 11 to the processing means 118.

In step e', after having verified that the identifier of the requesting train mentioned in the request corresponds to the identifier indicated in the allocation table 116, the processing means 118 compare the requested interlocking parameters with the parameters of the instantaneous interlocking state of the resource indicated in the state table 114. If the instantaneous state parameters of the resource are different from the requested interlocking parameters, the processing means 118 control the driving means 112 of the members of the resource in compliance with the requested interlocking parameters.

In step f1', the or each member 13 modifies the value of the corresponding characteristic parameter according to the required state.

In step f2', the members 13 transmit the current values of the parameter to the driving means 112, which update the state table 114.

In step g', the processing means 112 develop a resource interlocking response message. This response includes the identifier of the requesting train, the identifier for the requested resource, and the instantaneous interlocking state of the resource read in the state table 114.

In step h', the communication means 110 of the ROC 11 emit a radio signal corresponding to the interlocking response.

In step j', the communication means 210 of the board controller 21 pick up and decode the various signals that reach them, and only transfer the messages that include the identifier of the train 20 to the allocation/release means 213.

When the interlocking response indicates that the requested resource has been placed according to the requested interlocking parameters, the means 213 write, in the interlocking field corresponding to that resource, the value "1" (value k').

At the end of a predetermined duration after the transmission of the resource interlocking requests, the verification means 214 are executed to verify whether all of the resources from the list 217*b* have indeed been interlocked according to the requested interlocking parameters. The means 214 then test the value of the interlocking field of each of the resources from the list 217*b* (step 1').

When all of the resources are correctly interlocked, the verification means 214 authorize the train 20 to advance and start out on the path of the network 10 corresponding to the group of resources from the list 217*b* (step m').

When some of the resources are not correctly interlocked, the means 214 do not deliver the movement authorization and steps b' and c' may be iterated, at least for the incorrectly interlocked resources.

Figure 5:
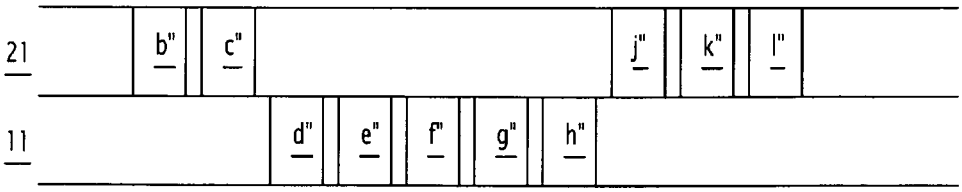
FIG. 5 is a schematic illustration of the release phase of said method.

Once the onboard controller 21 sees that the rear portion of the train 20 has crossed one of the resources from the list 217*b*, the identification means 212 are executed again to identify the next path of the network to be used (return to step a) and the allocation/release means 213 of the onboard controller 21 are executed to release this resource from the list 217*b*. This release phase can also take place on a list of resources that are identified, but have not been able to be allocated to the train. This release phase is shown in FIG. 5.

In step b", from the list 217*b*, the means 213 develop resource release request messages. Each request includes the identifier for the requesting train, and the identifier of the resource to be released.

In step c", the communication means 210 emit radio signals corresponding to these requests to release resources towards the various ROCs 11.

In step d", the communication means 110 of an ROC 11 pick up the different received radio signals and only transmit the messages including said ROC's identifier to the processing means 118.

In step e", the means 118 process the release request by reading, in the allocation table 116, the identifier of the train to which the resource was allocated. If the read identifier corresponds to the identifier of the train indicated in the request, the means 118 modify the allocation state (step f") of the resource by writing the value "unallocated" in the cell of the allocation table 116.

Only at that moment, the resource is released if no other reservation and/or no other interlocking has been recorded.

In step g", the processing means 112 develops a release response message. This response includes the identifier of the requesting train and the identifier of the requested resource.

In step h", the communication means 110 of the ROC 11 emit a radio signal corresponding to the release request.

In step j", the communication means 210 of the board controller 21 pick up and decode the different received signals, and only transfer the messages that include the identifier of the train 20 to the allocation/release means 213.

When the release response indicates that the resource has been released, the means 213 write the value "2" in the allocation field for that resource (step k").

At the end of a predetermined period after step c" for issuing resource release requests, the verification means 214 are executed to verify whether, yes or no, all of the resources from the list 217*b* have indeed been released. The verification means 216 then test the value of the allocation field for each of the resources of the list 217*b* (step 1").

In this method, there is no overbooking of a resource. On the other hand a resource can be interlocked by several trains for identical requested interlocking parameters.

Moreover, there is no connection between two resources on the network. Only the simultaneous allocation of two resources to the same train creates a "virtual" connection between those two resources.

Alternatively, the identification means 212 simultaneously identify several groups of resources corresponding respectively to alternative paths on the network, which the train can follow to perform its mission. Once the verification means 214 detect that groups of resources have been entirely allocated to the train 20, the other groups are released by executing the release means 213 on each of the other lists of resources.

In still another alternative, the identification means 212 implement an initial step for questioning the ground controllers 11 preset in the environment of the train 20 to determine the allocation state of the associated resources. This embodiment can advantageously be done using a protocol for exchanging request and response messages similar to the protocols previously described. Prior knowledge of the allocation state of the potential resources facilitates the identification strictly speaking of a group of identified resources.

The invention claimed is:

1. A method for managing circulation of vehicles on a railway network, the network being subdivided into a plurality of resources, each resource having an allocation state, assuming the value "allocated" or "unallocated," and having an interlocking state, assuming one value from among a plurality of predetermined values, one or several of the resources being driven by a ground controller equipped for wireless communication, a regulating unit capable of planning all of movements of the vehicles circulating on the network, and being connected to fixed base stations, on the ground, being equipped for wireless communication, and each vehicle circulating on the network including an onboard controller equipped for wireless communication permitting communication with the ground controllers and base stations connected to the regulating unit, the method comprising:

planning, by the regulating unit, of a mission assigned to a vehicle;

transmitting the mission from the regulating unit to the onboard controller of the vehicle;

identifying, by the onboard controller of the vehicle and for a given time slot of the mission, a group of resources that, on condition each of the resources being allocated to the vehicle and being in a required interlocking state, would permit the vehicle to continue said mission, by using a path on the network corresponding to the group of identified resources;

reserving the identified resources by implementing a predetermined protocol in the onboard controller requiring, from each of the ground controllers associated with the resources of the group of identified resources, the specific allocation of the resource to the vehicle;

then, once all of the resources of the group have been allocated to the vehicle, interlocking the resources by implementing a further predetermined protocol of the onboard controller requiring, from each of the ground controllers associated with the resources of the group of allocated resources, modification of the interlocking state of the resource in compliance with the required interlocking states;

verifying, by the onboard controller of the vehicle, that each of the resources of the group of identified resources has been allocated to the vehicle and is in the required interlocking state; and, when the result of the verifying step is affirmative, extending authorization, by the onboard controller, for the vehicle to move on the path of the network corresponding to the group of identified resources, allocated and correctly interlocked.

2. The method as recited in claim 1 wherein the onboard controller of a vehicle sends the regulating unit, via the base stations, information on the position and/or group of identified resources, and uses the information to update the various missions assigned to the vehicle and any other vehicles circulating on the railway network.

3. The method as recited in claim 1 further comprising releasing a resource allocated to a vehicle by carrying out a yet further predetermined protocol where the onboard controller of the vehicle requires, from the ground controller associated with the allocated resource that the resource no longer be allocated to vehicle.

4. The method as recited in claim 1 wherein the step for identifying a resource takes into account, in addition to the mission, descriptive information on the network and instantaneous position information on the vehicle.

5. The method as recited in claim 4 wherein the identification step includes a step for estimating a speed profile of the vehicle along a path of the network corresponding to a group of potential resources to determine the required time slot associated with each resource of a group of identified resources.

6. The method as recited in claim 1 wherein the reserving step for allocating the identified resource includes:

emitting, by the onboard controller of the vehicle, a request asking for the allocation of the identified resource sent to the ground controller associated with the identified resource;

emitting, by the ground controller, an allocation response delivering the allocation state and/or the interlocking state of the identified resource;

verifying, by the onboard controller, that there is no pending reservation and/or that no interlocking has interlocking states incompatible with requested interlocking states.

7. The method as recited in claim 1 wherein the interlocking step for engaging the allocated resource includes:

emitting, by the onboard controller of the vehicle, a request asking for the interlocking of the resource allocated to the vehicle, sent to the ground controller associated with the resource;

verifying, by the ground controller associated with the resource, whether interlocking parameters for a current state of the resource are different from requested interlocking parameters, and, in the affirmative, driving the resource according to the interlocking parameters; and emitting, by the ground controller, an interlocking response indicating the instantaneous interlocking state of the resource.

8. The method as recited in claim 3 wherein the step for releasing an allocated resource includes:

emitting, by the onboard controller of the vehicle, a request asking for the release of the resource allocated to said vehicle, sent to the ground controller associated with the resource;

verifying, by the ground controller associated with the resource, whether the latter is allocated to the vehicle and, in the affirmative, no longer allocating said resource to the vehicle;

emitting, by the ground controller, a release response indicating that the resource is no longer allocated to said vehicle.

9. A controller onboard a vehicle circulating on a railway network subdivided into a plurality of resources that respectively have an allocation state, assuming the value "allocated" or "unallocated," and an interlocking state, assuming one value from amongst a plurality of predetermined values, each resource of the network being associated with a single ground controller, each ground controller including: radio communications; a processor permitting allocation of the associated resource and ordering a change in the interlocking state of the associated resource; a driver capable of determining the instantaneous interlocking state of the associated resource and, on command by the processor, driving the associated resource according to interlocking parameters of a received interlocking request, the onboard controller comprising:

onboard controller radio communications permitting exchange of messages between the onboard controller and the ground controllers;

an identifier permitting identification of a group of resources that, on condition of each of the resources being allocated to the vehicle and being in a requested interlocking state, would permit the vehicle to continue a mission, by taking a path on the network corresponding to the group of identified resources, the mission being managed by a regulating unit including a planner so as to manage, on a network scale, movements of the vehicle and any other vehicles and to create a mission for each of the vehicle and any other vehicles, the regulating unit being connected to fixed base stations, on the ground, including a wireless communications permitting communication with the onboard controller to transmit the mission assigned to the vehicle;

an allocator and releaser permitting, from a group of identified resources, generation of resource allocation requests intended to be sent to the ground controllers associated with the identified resources, and processing of resource allocation responses coming from the ground controllers, and permitting, from a group of allocated resources, generation of resource interlocking requests, which include interlocking parameters, intended to be sent to the ground controllers associated with the allocated resources, and processing of resource interlocking responses coming from the ground controllers; and a verifier permitting verification that all of the resources of a group of identified resources have been allocated to said vehicle and that all of the resources of a group of allocated resources are in the requested interlocking state.

10. The onboard controller as recited in claim 9 wherein allocator and releaser are capable, based on a plurality of allocated resources, of generating resource release requests intended to be sent to the ground controllers associated with the allocated resources, and to process resource release responses coming from the ground controllers.

11. The onboard controller as recited in claim 9 further comprising a positioner capable of delivering instantaneous position information for the vehicle.

12. The onboard controller as recited in claim 9 further comprising a database including details of the resources composing the railway network.

13. The onboard controller as recited in claim 9 further comprising an estimator for estimating a speed profile of the vehicle on a group of potential resources.

14. The onboard controller as recited in claim 9 further comprising at least one list corresponding to a group of identified resources, the list including, for each resource in the group: a resource identification field; a field corresponding to a required allocation time slot for the resource; a field corresponding to the "allocated" or "unallocated" allocation state of the resource to the vehicle; a field defining the required interlocking state for the resource; and an interlocking field corresponding to a flag indicating that the resource is indeed in the required interlocking state.

15. A ground controller capable of being associated with at least one resource of a railway network subdivided into a plurality of resources that respectively have an allocation state, assuming the value "allocated" or "unallocated," and an interlocking state, assuming one value from amongst a plurality of predetermined values, and, onboard a train circulating on the network, an onboard controller including radio communications and an allocator and releaser permitting generation of a resource allocation request intended to be sent to the ground controller, or a resource interlocking request including interlocking parameters and intended to be sent to the ground controller, the ground controller comprising:

radio communications capable of receiving an allocation or interlocking request for the resource associated with the ground controller;

a processor capable of allocating the associated resource in compliance with a received allocation request and ordering a modification of the interlocking state of the associated resource in compliance with a received interlocking request; and a driver capable of determining the instantaneous interlocking state of the associated resource and, upon command from the processor, driving the associated resource according to the interlocking parameters of the interlocking request.

16. The ground controller as recited in claim 15 further comprising an allocation table including a stack of cells, each cell containing either the value NULL, or the identifier for a vehicle to which the resource is allocated.

17. The ground controller as recited in claim 15 further comprising, for each resource associated with it, an interlocking state table including as many fields as there are parameters characterizing the interlocking state of said resource.

18. A ground controller capable of being associated with at least one resource of a railway network subdivided into a plurality of resources that respectively have an allocation state, assuming the value "allocated" or "unallocated," and an interlocking state, assuming one value from amongst a plurality of predetermined values, and, onboard a train circulating on the network, an onboard controller according to claim 9, the ground controller comprising:

radio communications capable of receiving an allocation or interlocking request for the resource associated with the ground controller;

a processor capable of allocating the associated resource in compliance with a received allocation request and ordering a modification of the interlocking state of the associated resource in compliance with a received interlocking request; and a driver capable of determining the instantaneous interlocking state of the associated resource and, upon command from the processor, driving the associated resource according to the interlocking parameters of the interlocking request.

19. A system for managing the circulation of vehicles on a railway network subdivided into a plurality of resources, each resource having an allocation state assuming the value "allocated" or "unallocated" and having an interlocking state, assuming one value from amongst a plurality of predetermined values, the system comprising:

a plurality of ground controllers, each ground controller as recited in claim 18;

the onboard controller onboard a vehicle; and, a regulating unit including a planner so as to manage, on the network scale, movements of the vehicles and to create a mission for each of them, the regulating unit being connected to fixed base stations, on the ground, including wireless communications permitting communication with the onboard controller of a vehicle to transmit the mission generated by the regulating unit assigned to the vehicle.

* * * * *